US006706133B1

(12) United States Patent
Erkkilä

(10) Patent No.: US 6,706,133 B1
(45) Date of Patent: Mar. 16, 2004

(54) METHOD AND DEVICE FOR JOINTING CORE ENDS

(75) Inventor: Matti Erkkilä, Lohtaja (FI)

(73) Assignee: A.P.E.-Trading Oy (FI)

( * ) Notice: Subject to any disclaimer, the term of this patent is extended or adjusted under 35 U.S.C. 154(b) by 0 days.

(21) Appl. No.: 09/743,698

(22) PCT Filed: May 12, 1999

(86) PCT No.: PCT/FI99/00411

§ 371 (c)(1),
(2), (4) Date: Jan. 16, 2001

(87) PCT Pub. No.: WO00/03868

PCT Pub. Date: Jan. 27, 2000

(30) Foreign Application Priority Data

Jul. 15, 1998 (FI) ..... 981613

(51) Int. Cl.[7] ..... B32B 35/00

(52) U.S. Cl. ..... 156/94; 156/304.2; 156/304.5; 156/535; 156/556

(58) Field of Search ..... 156/94, 158, 304.2, 156/304.5, 502, 503, 535, 556

(56) References Cited

U.S. PATENT DOCUMENTS 4,174,996 A * 11/1979 Hunter ..... 156/499

FOREIGN PATENT DOCUMENTS

| | | |
|---|---|---|
| EP | 0 755 893 A2 | 1/1997 |
| WO | WO 94/19271 | 9/1994 |
| WO | WO 95/14631 | 6/1995 |

* cited by examiner

*Primary Examiner*—Michael W. Ball
*Assistant Examiner*—Todd J. Kilkenny
(74) *Attorney, Agent, or Firm*—Connolly Bove Lodge & Hutz LLP

(57) ABSTRACT

A method for end-to end joining of paper rolls into a continuous core master is provided. The primary goal of the method is to produce usable paper roll cores from those returned for recycling after use. According to the aforementioned method, the ends of core sections are reworked into complementary shapes required for mating a joint, glue is applied to the complementary mating surfaces of the joint, the ends of the core sections are pushed in an axial direction abutting each other and the glue is set. The cross section of the cores is trued circular at least over the area of the joined core sections by applying a radial, compressive trueing force on the joint. The trueing force is also used for braking axial travel of the core sections during the joining of the core sections. An apparatus for implementing the method is also provided.

11 Claims, 1 Drawing Sheet

METHOD AND DEVICE FOR JOINTING CORE ENDS

The present invention relates to a method and apparatus for end-to-end joining of paper roll cores. Conventionally, a paper web is wound up during different finishing operations on a core made from a plurality of spirally overlappingly wound plies of narrow strips of board. Prior to their winding into a core, the board strips are glued, conventionally using a sodium silicate solution. The finished core length must be exactly matched with the width of the paper web exiting from a slitter and being wound on the core. Furthermore, the core must be flawless to avoid problems with the chucks of winder equipment employed in the final use and/or finishing of the roll.

A used core presents an essential waste problem, since its material as such is not reusable. Consequently, while substantial effort has been made to find possibilities of recycling cores, this approach also involves problems. One problem is the damage caused to the core ends during normal use. Conventionally, methods of overcoming this drawback have been sought from reworking of core sections. A basic goal of reworking is to remove the damaged portion from the core end and then to join the thus reworked core end with the end of another core section similarly reworked so as to form a continuous core master that can be severed to desired lengths In the art, different kinds of methods and apparatuses have been developed for reworking and joining core ends. One type of apparatus for smoothing and end-to-end joining of core ends is disclosed in SE patent publication No. 502,067. Respectively, the SE laid-open publication 470,442 describes a method and apparatus suited for working the ends of cores to be reworked into complementary mating outer/inner end cones that are then joined with glue.

In the method described in the latter publication, the core ends that are first trimmed straight are reworked using conical milling equipment. The mill working the core end into an inner cone is provided with a milling head dimensioned according to the diameter of the core being reworked. The milling head is aligned coaxially with the longitudinal axis of the core. Respectively, the outer cone end is worked using conical milling equipment performing a rotary movement about an axis perpendicular to said longitudinal axis of the core, whereby the outer edge of the core end will be worked into a tapering cone having a cone angle determined by the envelope angle of the conical cutting surface of the milling head, as the core end is rotated past the milling head. In cited embodiment, the cores being reworked are rotated on two support rolls mounted parallel to the longitudinal axis of the core by means of a friction drive roll which is placed above the core so as to run on the surface thereof.

An essential drawback of the above-described method and the apparatus implementing the method is that the possible out-of-roundness of the core cross section cannot be corrected by any means during the reworking of the core to be recycled. In fact, the working tools of a fixed shape and aligned to the estimated center axis of the core perform the reworking of the core ends in rigid manner irrespective of any possible out-of-roundness deviations of the core cross section. Obviously, this causes unavoidable mismatch problems in joining the core ends when a core with an out-of-round end is to be reworked. Moreover, cited apparatus is handicapped by having the reworking of core ends and the end-to-end joining thereof arranged to occur in separate machine units.

The present invention provides a method and an apparatus for joining the ends of cores such that the cores are reworked using a substantially reduced number of steps as compared to those required in the prior-art techniques. Moreover the present method outperforms the prior an methods by making a more accurate end-to-end joint between the core ends, as well as a straighter joined core master with a cross section of good roundness.

The invention is next illustrated in greater detail with reference to the appended schematic drawings in which.

Figure 1:
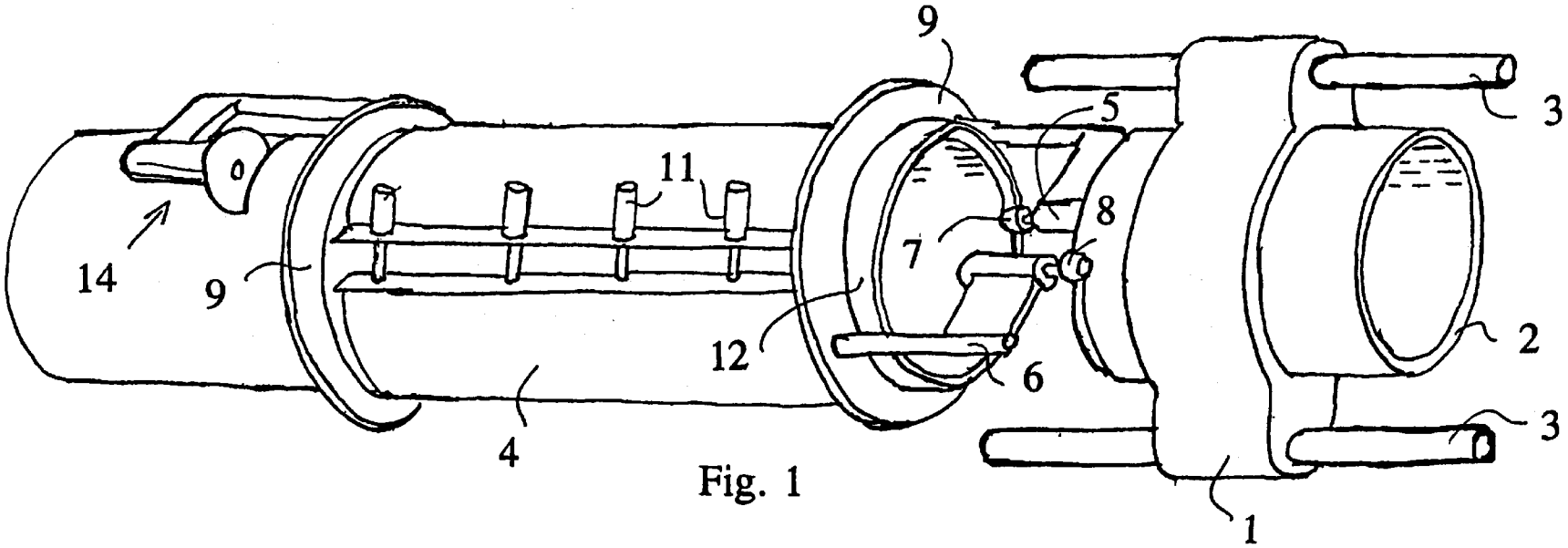
FIG. 1 shows schematically an embodiment of an apparatus suited to implement the method according to the invention.

With reference to FIG. 1, the embodiment of the apparatus shown therein comprises a clamp sleeve 1 and a radially compressing tool 4 as its basic parts. In the illustrated embodiment, the radially compressing apparatus is designed using a clamp sleeve construction which is supported by a suitable frame structure (not shown) coaxially with the clamp sleeve 1. The inner diameter of the clamp sleeves used in the apparatus are selected to be compatible with the outer diameter of the cores being machined. Herein, the diameter of cores may vary in the range from 3 to 12 inches. Of the sleeve members, sleeve member 1 acts as a clamp sleeve suitable for fetching a new core section 2 to the joining apparatus for joining to the previous core section. For this task, the clamp sleeve is made expandable by its inner diameter to accept the insertion of a core section therein and, respectively, contractible for grabbing the inserted core section. Alternatively, the clamp sleeve may have an open/close type of design to accomplish the required function. Advantageously, the inner diameter of the clamp sleeve in its grabbing position has a diameter which is equal to the nominal outer diameter of the core and has a circular perimeter, thus facilitating the trueing of a possibly flattened core end back into a circular shape. Purposefully, the clamp sleeve 1 is made reciprocatingly movable along guides 3.

The other sleeve member is a mandrel sleeve 4 serving a plurality of functions. The mandrel sleeve 4 is located so that the guides 3 will force the movement of the clamp sleeve 1 to occur coaxially with regard to the center axis of the mandrel sleeve. A principal function of the mandrel sleeve 4 is to serve as a source of a radial pressure that imposes an radial compressive force towards the jointed cores 2 and 12, especially in their joint area. The mandrel sleeve 4 is shaped so as to make this sleeve member to perform the trueing of the circular cross section of the core over the length of the joint seam and simultaneously to secure reliable mating of the complementary ends of the core sections being joined.

The above-described function of the radially compressing sleeve member 4 is compatible with a plurality of different mating joint shapes of core ends not necessarily possessing a self-centering property during joining. Another principal function of the radial outwardly acting sleeve member 4 is to act as a thrust by means of which the reworked ends of core sections can be pushed against each other.

These intended functions can be accomplished using different radially compressing device constructions. A practicable design is the collet-type sleeve clamp shown in FIG. 1 that has its bore dimensioned to accommodate the diameter of the core being machined. The sleeve clamp can be tightened about the cores to be joined so as to establish a suitable degree of sliding friction between the outer surface of the cores being joined and the inner surface of the sleeve clamp. To this end, the sleeve clamp is split along its axial direction and equipped with suitable means 11 for adjusting the inner diameter of the sleeve clamp. Such means can be, e.g., pneumatic cylinders. To achieve a controlled behaviour of the compression step, the length of the mandrel sleeve is advantageously made slightly larger than its diameter. The length of the mandrel sleeve can be manyfold with regard to its diameter, e.g., about three-fold.

Essentially the same functions required in the apparatus can be accomplished by means of, e.g. endless belts running longitudinally parallel and circumferetially spaced apart from each other along the cores, and passed over idlers respectively longitudinally spaced apart from each other so that one leg of each belt loop will run along the outer surface of the core sections. Then, a pressure exerted by the idlers radially toward the center axis of the core sections, combined with a simultaneous braking action, can provide the same compression and braking functions as the clamp sleeve construction shown in FIG. 1. Also other types of friction drive wheel arrangements adapted about the perimeter of the core sections can be advantageously used.

Figure 2:
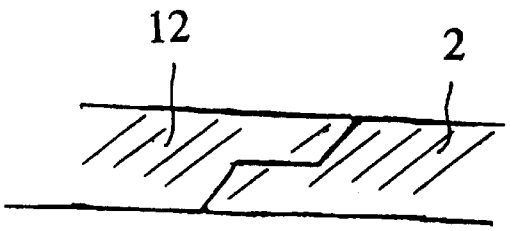
FIG. 2 shows a possible embodiment of the end-to-end core joining method.
Figure 3:
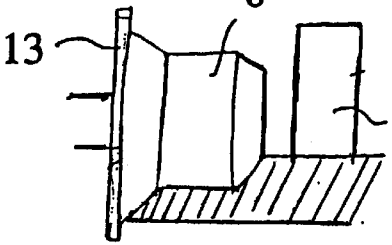
FIG. 3 shows a detail of the cutter head tooling of the apparatus illustrated in FIG. 1.

The ends of the core sections to be joined are worked with machining tools that in the illustrated embodiment are adapted supported by the clamp sleeve 4. The tooling is mounted on a bearing 9 which is adapted to perform a controlled rotary movement about the entry end of the clamp sleeve 4. The tooling comprises tool support arms 5 and 6 that support cutter heads 7 and 8 equipped with drive means. The tool support arms 5 and 6 include appropriate pivot joints about which the cutter heads can be rotated into contact with the core end to be reworked and, respectively, out of way when the ends of the reworked core sections are to be mated. One of the cutter heads is adapted to work the trailing end of the previous core section while the other cutter head can work the leading end of the next core section, respectively. The complementary mating core end surfaces are worked into a suitable shape so that material is removed from the outer edge of one core section end while the other core section is worked to remove material from the inner edge of its end. A useful complementary joint shape of core ends is shown in FIG. 2.

In the scope and spirit of the invention, an alternative embodiment of apparatus construction may be contemplated in which the ends of core sections to be mated are worked using an essentially stationary tooling that during reworking follows the circumferential contour of a rotated core section. Herein, the term essentially stationary tooling must be understood as referring to an arrangement in which the tooling can perform, e.g., a radially linear movement following the peripheral contour of the core section or, alternatively, assume a new working position when so required.

Obviously, reworking can be performed on both the inner surface and the outer surface of the core end. While material removal occurring relative to the circumferential contour of the core section end is advantageously insensitive to out-of-roundness variations of the core cross section, the method may as well be applied to a core having an already trued circular cross section.

The working depth control of the cutter heads is advantageously implemented with the help of a follower wheel 10 adapted to follow the circumferential contour of the core section end to be reworked. This arrangement secures the correct working depth of the cutter head at any peripheral point of the core section end irrespective of any possible out-of-roundness deviations. Advantageously, the cutter heads 7 and 8 performing as the shape-working heads also include a trimming bit 13 with which the end of the core section is trimmed simultaneously with the shaping of the core end. The clamp sleeve 1 is adapted to move the next core section 2 waiting for the shaping of its end at such a working distance from the cutter heads so that the length possibly to be removed from the core end is properly set. The illustrated shape of core section ends has a self-centering property during mating.

Further in the scope and spirit of the invention, the core section ends may be reworked using a substantially radially acting cutting effect that can be accomplished by sawing or by cutting with a high-impact abrasive medium jet such as a high-pressure waterjet. A useful complementary shape of the mating surfaces is toothing, e.g., made into a serrated or undulated shape of teeth. In this joining technique, the complementary shapes of mating core ends are made using toothed surface shapes that are aligned radially orthogonal to the core center axis, which means that the mating surfaces do not contain surface elements capable of self-centering the ends of the core sections to be joined. This is, however, insignificant due to the principal characterizing feature of the invention specifying such a trueing compression to be imposed over the area of the joint that can accomplish axial alignment of the complementary mating surfaces of the core end joint. One benefit of the latter core end joining technique is the easy workability of the core ends. In practice, the material of cores has, namely, been found extremely difficult to cut.

For joining, the abutting core end surfaces reworked in the above-described method, or at least one of them, is treated in a conventional manner with a glue of an appropriate grade such as a latex dispersion glue. The core section ends treated with glue are then pushed in an abutting manner against each other by means of the clamp sleeve, whereby the radially expandable mandrel sleeve 4 forms an anvil producing a sufficient counter-force. The thus joined core section is next pushed over the mandrel sleeve so deep that the trailing end of the joined core section remains overextending past the mandrel sleeve end by the length of the working area required for making the next joint. During the next joining operation, the previous joint remains rigidly clamped within the clamp sleeve structure, whereby the glue in the joint is given a sufficient time to set while the joint is subjected to both an axially applied abutting force and a radially applied compression that performs trueing of the joint shape. This arrangement secures a strong end-to-end joint between the core sections, as well as a superior straightness of the joint. When required, the setting of the glue in the joint can be accelerated by heating the jacket of the clamp sleeve assembly.

The method according to the invention and the apparatus implementing the invention facilitate an essentially continuous operation by virtue of the fast rate at which the working and glueing of the core section ends can be performed.

The apparatus is also complemented with a conventional severing device 14 for severing a core master made by joining from reworked core sections into winding cores of predetermined lengths ready for reuse.

What is claimed is:

1. A method for end-to end joining of paper roll core sections into a continuous core master, said method comprising:

transferring a subsequent core section to jointing machinery in order to join the subsequent core section to a previous core section, wherein the subsequent and previous core sections each have a first end and a second end and a tubular wall extending between the first and second ends, and wherein the tubular wall has a peripheral contour and a thickness;

working a second end of the previous core section and a first end of the subsequent core section into complementary mating joint surfaces with moving tools, while the previous and subsequent core sections are stationary, by diminishing the thickness of the tubular wall at the second end of the previous core section and the first end of the subsequent core section, and, while working, controlling a working depth of material removal to follow the peripheral contour of the subsequent core section and the previous core section;

applying glue to the joint surfaces after working the second end of the previous core section and the first end of the subsequent core section; and pushing the first and second core sections against each other in an axially abutting manner to bring the joint surfaces together after applying the glue to the joint surfaces.

2. The method according to claim 1, further comprising applying a radial, compressive trueing force on joined core sections, wherein said trueing force is used for braking axial travel of joined core sections during joining of other core sections.

3. The method according to claim 1, wherein working the second end of the previous core section and the first end of the subsequent core section into complementary mating joint surfaces further comprises working the second end of the previous core section and the first end of the subsequent core section with surface elements aligned essentially radially orthogonal to a center axis of the subsequent and previous core sections.

4. The method according to claim 3, further comprising making said complementary mating joint surfaces into a shape of axially cut teeth.

5. The method according to claim 3, wherein working the second end of the previous core section and the first end of the subsequent core section comprises working the second end of the previous core section and the first end of the subsequent core section simultaneously into mating shapes.

6. The method according to claim 3, farther comprising trueing the cross section of the subsequent core while transferring the subsequent core section to the jointing machinery.

7. The method according to claim 2, wherein working the second end of the previous core section and the first end of the subsequent core section into complementary mating joint surfaces further comprises working the second end of the previous core section and the first end of the subsequent core section with surface elements aligned essentially radially orthogonal to a center axis of the subsequent and previous core sections.

8. An apparatus for end-to-end joining of paper roll core sections into a continuous core master, said apparatus comprising:

a cylindrical clamp sleeve arranged to grab a first core section and to transfer the first core section axially into a suitable position for working;

tool support arms supporting cutter beads arranged to work an end of the first core section and an end of a second core section, wherein the tool support arms are equipped with a follower wheel arranged to control a working depth of the cutter heads to follow the peripheral contour of the subsequent core section and the previous core section; and a mandrel sleeve displaced coaxially with said clamp sleeve, so as to perform a trueing of the peripheral contour of a joint made in a joined core and to brake axial travel of the joined core.

9. The apparatus according to claim 8, wherein said mandrel sleeve has a cylindrical shape and is radially expandable in order to control a radial expansion force produced by the mandrel sleeve.

10. The apparatus according to claim 8, wherein said tool support arms are pivotally mounted on a bearing supported on said mandrel sleeve.

11. The apparatus according to claim 8, wherein said mandrel sleeve is heatable.

* * * * *